US007637579B2

(12) United States Patent
Nishida

(10) Patent No.: US 7,637,579 B2
(45) Date of Patent: Dec. 29, 2009

(54) INK-JET PRINTER, AND METHOD FOR ATTACHING INK CARTRIDGE

(75) Inventor: Katsunori Nishida, Aichi-ken (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 466 days.

(21) Appl. No.: 11/728,443

(22) Filed: Mar. 26, 2007

(65) Prior Publication Data

US 2007/0229572 A1 Oct. 4, 2007

(30) Foreign Application Priority Data

Mar. 31, 2006 (JP) ..... 2006-098310

(51) Int. Cl.
*B41J 29/38* (2006.01)
*B41J 2/175* (2006.01)

(52) U.S. Cl. ..... 347/6; 347/85

(58) Field of Classification Search ..... 347/6, 347/85

See application file for complete search history.

(56) References Cited

U.S. PATENT DOCUMENTS 5,485,187 A * 1/1996 Okamura et al. ..... 347/85
2002/0196312 A1* 12/2002 Ishizawa et al. ..... 347/50
2004/0017422 A1* 1/2004 Katsuumi ..... 347/30
2004/0196339 A1* 10/2004 Kobayashi et al. ..... 347/85
2005/0122380 A1 6/2005 Nakamura et al.
2006/0132554 A1* 6/2006 Ota et al. ..... 347/85

FOREIGN PATENT DOCUMENTS

JP 10-272785 10/1998
JP 2005-144680 6/2005
JP 2005-161761 6/2005

* cited by examiner

*Primary Examiner*—Julian D Huffman
(74) *Attorney, Agent, or Firm*—Reed Smith LLP

(57) ABSTRACT

An ink-jet printer that includes: a carriage on which a recording head having nozzles for discharging ink and a buffer tank for supplying the ink to the recording head are mounted; an exhaust valve provided on an exhaust path for exhausting air in the buffer tank to the outside; an attaching unit disposed outside the carriage and at a height lower than the recording head, to which the ink cartridge is detachably attached; an ink flow passage having one end portion to which the ink cartridge to be attached to the attaching unit is detachably connected, for supplying the ink in the ink cartridge to the buffer tank. The ink in the ink flow passage moves to the side of the ink, due to the head difference between the buffer tank and the ink cartridge, by opening the exhaust valve when the ink cartridge is attached to the attaching unit.

17 Claims, 7 Drawing Sheets

INK-JET PRINTER, AND METHOD FOR ATTACHING INK CARTRIDGE

CROSS-REFERENCE OF RELATED APPLICATIONS

This Nonprovisional application claims priority under 35 U.S.C. §119(a) to Japanese Patent Application No. 2006-098310 filed in Japan on Mar. 31, 2006, the entire contents of which are hereby incorporated by reference.

BACKGROUND OF THE INVENTION

1. Field of the Invention

The present invention relates to an ink-jet printer and especially to a method for attaching an ink cartridge therefor.

2. Description of the Related Art

According to a conventional ink-jet printer, ink is supplied from an ink cartridge which stores the ink to a recording head which has a plurality of nozzles and printing is performed on a recording paper by discharging the ink from the plurality of nozzles. Since the ink in the recording head is consumed by discharging the ink, it is necessary to supply the ink from the ink cartridge constantly. Therefore, various kinds of methods for supplying the ink to the recording head have been proposed.

According to a first related art disclosed in Japanese Patent Application Laid-Open No. 10-272785 (1998), an ink cartridge is detachably attached to a carriage on which a recording head is mounted, ink is supplied from the ink cartridge to the recording head through an ink supply path, and the ink is discharged from nozzles. In addition, according to a second related art disclosed in Japanese Patent Application Laid-Open No. 2005-144680, ink in an ink cartridge attached to an attaching unit of an ink-jet printer (a recording apparatus in the second related art) body is stored once in an ink tank mounted on a carriage through an ink tube connected to an ink extraction pipe of the attaching unit, and then it is supplied from the ink tank to a recording head.

However, according to the first related art, when a user attaches the ink cartridge for the first time or exchanges the ink cartridge, since the ink at the end portion of the ink supply path on the side of the ink cartridge is removed, in a case where a new ink cartridge is attached, bubble enters between the ink in the supply path and the ink in the cartridge. Although it is necessary to remove the ink on the down stream side than the bubble by suctioning operation in order to remove the bubble, if any a little amount of bubble remains, the bubble gradually grows and the ink cannot be discharged. In addition, according to the first related art, after the ink in the ink supply path and the recording head has been discharged completely by suctioning operation and the ink cartridge has been attached, the ink is introduced in empty ink supply path and recording head. However, in this case, a problem that a large amount of ink is discharged uselessly before the ink cartridge is attached occurs.

Similarly, according to the second related art, when a new ink cartridge is attached, bubble enters between the ink extraction pipe and the ink cartridge. Therefore, it is necessary to draw the ink from the ink cartridge to the side of the recording head by suctioning the ink from the nozzles of the recording head to move the bubble. In addition, according to the second related art, since the distance between the ink cartridge and the recording head is longer than that of the first related art, a problem that amount of waste ink is increased occurs.

BRIEF SUMMARY OF THE INVENTION

The present invention was made to improve the above problems and it is an object of the present invention to provide a method for attaching an ink cartridge in which bubble can be removed by simple configuration and method, and amount of waste ink at that time is reduced when the ink cartridge is attached, and an ink-jet printer for implementing the method for attaching the ink cartridge.

One aspect of the present invention is a method for attaching an ink cartridge. In the such aspect, the ink-jet printer is provided with: a carriage on which a recording head having nozzles for discharging ink and a buffer tank for supplying the ink to the recording head are mounted; an exhaust valve provided on an exhaust path that exhausts air in the buffer tank to the outside; an attaching unit disposed outside the carriage and at a height lower than the recording head, to which the ink cartridge is detachably attached; an ink flow passage, to whose one end the ink cartridge to be attached to the attaching unit is detachably connected, that supplies the ink in the ink cartridge to the buffer tank; a sensor that detects whether or not the cartridge is attached to the attaching unit; and a control circuit that controls the exhaust valve. The method is characterized by comprising: detecting by the sensor whether or not the cartridge is attached to the attaching unit; opening the exhaust valve by the control circuit when the sensor detects a change from a state where the cartridge is not attached to the attaching unit to a state where the cartridge is attached to the attaching unit; and moving the ink in the vicinity of the one end of the ink flow passage to which the ink cartridge is connected, into the ink cartridge, by moving the ink in the ink flow passage from the side of the buffer tank to the side of the ink cartridge due to a head difference between a head of the ink in the buffer tank and a head of the ink in the ink cartridge when the valve is opened.

Also, another aspect of the present invention is an ink-jet printer. Such ink-jet printer is characterized by comprising: a carriage that on which a recording head having nozzles for discharging ink and a buffer tank for supplying the ink to the recording head are mounted; an exhaust valve provided on an exhaust path that exhausts air in the buffer tank to the outside; an attaching unit disposed outside the carriage and at a height lower than the recording head, to which the ink cartridge is detachably attached; an ink flow passage, to whose one end the ink cartridge to be attached to the attaching unit is detachably connected, that supplies the ink in the ink cartridge to the buffer tank; a sensor that detects whether or not the cartridge is attached to the attaching unit; and a control circuit that opens the exhaust valve when the sensor detects a change from a state where the cartridge is not attached to the attaching unit to a state where the cartridge is attached to the attaching unit. In such ink-jet printer, the ink in the vicinity of the one end of the ink flow passage to which the ink cartridge is connected moves into the ink cartridge, by moving the ink in the ink flow passage from the side of the buffer tank to the side of the ink cartridge due to a head difference between a head of the ink in the buffer tank and a head of the ink in the ink cartridge when the valve is opened.

According to the method of one aspect and the ink-jet printer of another aspect of the present invention, the attaching unit is disposed outside the carriage and at a height lower than the recording head. The ink cartridge is detachably attached and ink is supplied to the buffer tank mounted on the carriage through the ink flow passage connected to the ink cartridge. When the ink cartridge is attached to the attaching unit, the exhaust valve of the exhaust path provided in the buffer tank is opened and the ink in the ink flow passage is moved to the side of the ink cartridge due to the head difference between a head of the ink of the buffer tank and a head of the ink of the ink cartridge. As a result, the ink in the vicinity of one end portion of the ink flow passage connected to the ink cartridge is moved into the ink cartridge. Therefore, the bubble entered when the ink cartridge is attached can be pushed out into the ink cartridge by the easy configuration and method. Thus, it is not necessary to discharge the ink in the ink flow passage from the recording head in large amounts to remove the bubble after the ink cartridge has been attached, so that the ink can be saved.

The above and further objects and features of the invention will more fully be apparent from the following detailed description with accompanying drawings.

DETAILED DESCRIPTION OF THE PRESENT INVENTION

Figure 1:
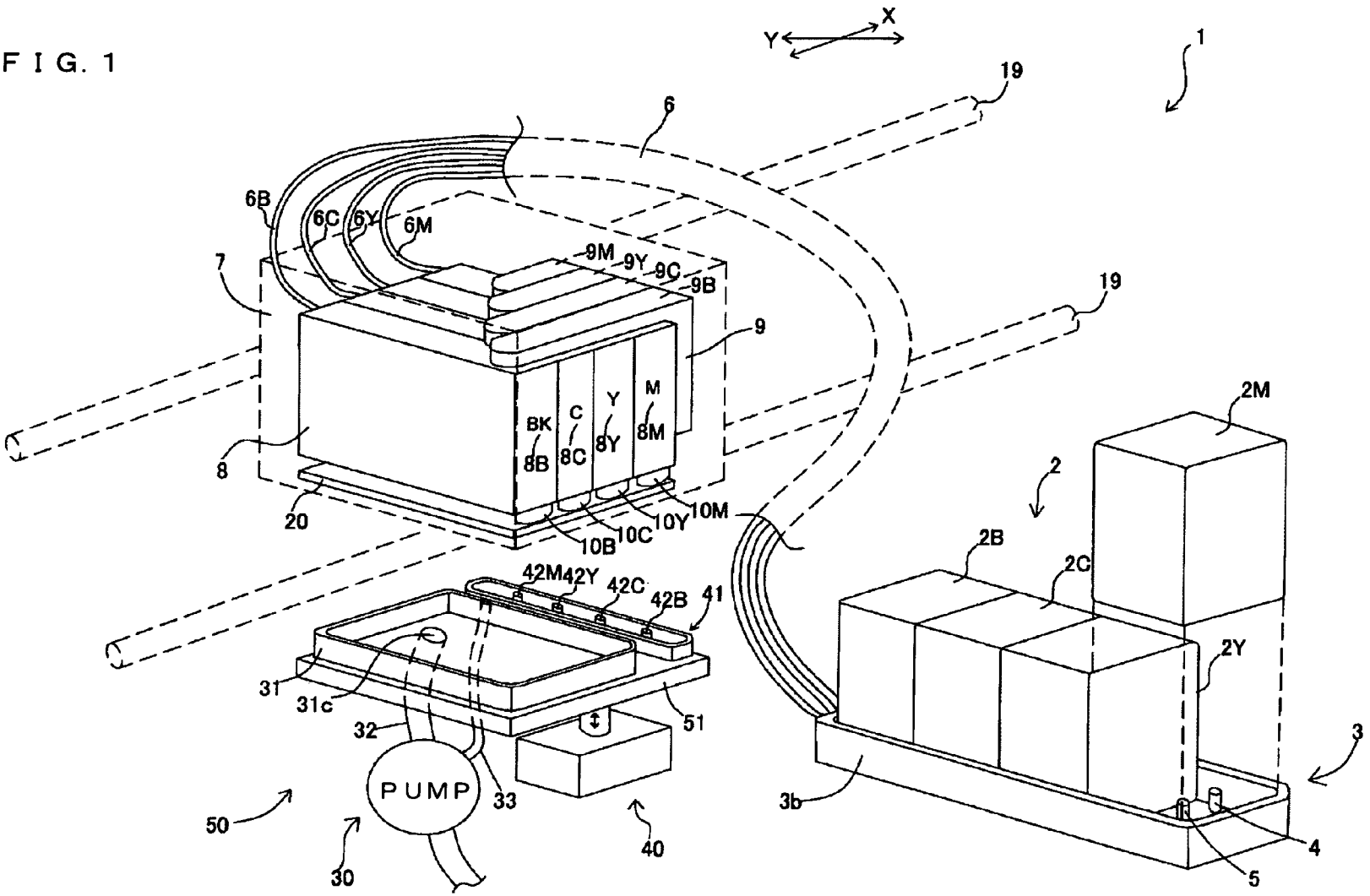
FIG. 1 is a schematic view showing a configuration example of an essential portion of an ink-jet printer according to the present invention.

One embodiment of the present invention will be described with reference to the drawings hereinafter. In addition, it is to be noted that the side to which ink is discharged is assumed to be a lower surface and a lower direction, and the side opposite to the above side is assumed to be an upper surface and an upper direction in the following description. In addition, a scanning direction (X direction) of a carriage 7 shown in FIG. 1 is assumed to be a right and left direction. Furthermore, as for ink colors, B, C, Y and M stand for black, cyan, yellow and magenta, respectively.

FIG. 1 is a schematic view showing the configuration example of an essential portion of an ink-jet printer according to the present invention. Referring to FIG. 1, a description will be made of the configuration of the essential portion of the ink-jet printer 1 according to the present invention.

In the ink-jet printer 1 according to the present invention, ink is supplied from an ink cartridge 2 attached to an attaching unit 3 and storing the ink, to a recording head 20 having a plurality of nozzles (not shown) through a buffer tank 8 mounted on an approximately box-shaped carriage 7. The carriage 7 is slidably mounted on two guide shafts 19 and 19 which are disposed in parallel with each other. While the carriage 7 is guided by the two guide shafts 19 and 19 and moved in the scanning direction (right and left direction, that is, X direction) and the ink is discharged from the plurality of nozzles, a printing is performed on a recording paper (not shown).

The ink cartridge 2 stores the inks of black (B), cyan (C), yellow (Y) and magenta (M), for example. In addition, reference numerals 2B, 2C, 2Y and 2M designate ink cartridges 2 for black, cyan, yellow and magenta, respectively. Each ink cartridge 2 is connected to one end of an ink tube 6 (6B, 6C, 6Y or 6M) as an ink flow passage of respective colors, and the ink of each color is supplied to each buffer tank 8 (8B, 8C, 8Y or 8M).

In the carriage 7, the recording head 20 is fixed to its bottom portion of the and the plurality of buffer tanks 8 are provided on the recording head 20. Because ink flow pipes 10B, 10C, 10Y and 10M provided in the buffer tanks 8B, 8C, 8Y and 8M, respectively are communicated with the recording head 20, the ink of each color is supplied to the recording head 20. In addition, the bottom portion of the carriage 7 is opened and a nozzle surface provided on the lowermost surface of the recording head 20 is exposed.

For example, according to the recording head 20, as disclosed in Japanese Patent Application Laid-Open No. 2005-161761, a plurality of plates are laminated and bonded, in which a cavity plate (not shown) to which the ink is supplied from the buffer tank 8 and a piezoelectric actuator (not shown) in the shape of a plate having a plurality of piezoelectric transformation elements are bonded, and a flexible wiring material (not shown) on which a drive circuit 21 (refer to FIG. 4) is provided on the upper surface thereof. The piezoelectric actuator and the drive circuit 21 are electrically, in other words, controllably connected by an electric signal. Although it is not shown, a plurality of nozzle rows each discharging the ink of respective ink colors are provided on the nozzle surface at the lowermost surface of the cavity plate in the direction (Y direction) perpendicular to the scanning direction of the carriage 7. Therefore, when a printing signal outputted from the drive circuit 21 selectively deforms the piezoelectric transformation element, the ink is discharged from the corresponding nozzles.

As shown in FIG. 1, a maintenance unit 50 is disposed at one end portion of the right and left direction (X direction) of the ink-jet printer 1 and below the guide shafts 19 and 19. In addition, a well-known wiper member (not shows) that wipes and cleans nozzle surface of the recording head 20 is disposed beside the maintenance unit 50. The maintenance unit 50 will be described below.

Figures 2A, 2B:
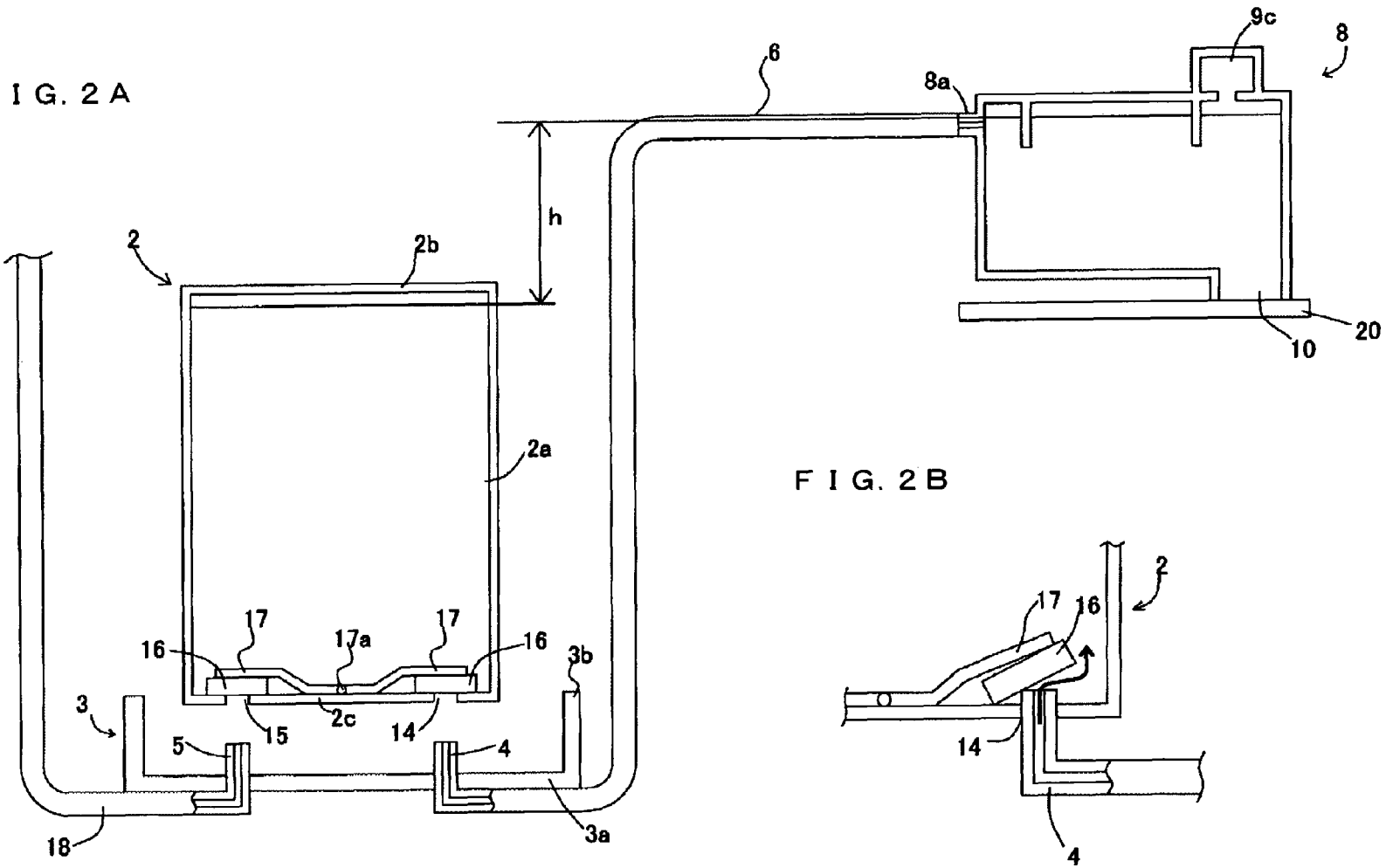
FIG. 2A is a schematic view showing a connection state between a buffer tank and an ink cartridge.
FIG. 2B is an enlarged schematic view showing an operation state of a valve member when the ink cartridge is attached to an attaching unit.

FIG. 2A is a schematic view showing a connection state between the buffer tank and the ink cartridge, and FIG. 2B is an enlarged schematic view showing an operating state of a valve member when the ink cartridge is attached to the attaching unit.

As shown in FIG. 1, FIG. 2A and FIG. 2B, the ink cartridge 2 is detachably attached to an attaching unit 3. The attaching unit 3 mainly comprises a base portion 3*a*, and a guide portions 3*b* rising from both sides of the base portion 3*a*. A hollow ink supply pipe 4 for supplying the ink stored in the ink cartridge 2 to the buffer tank 8 and a hollow air introduction pipe 5 for introducing air into the ink cartridge 2 are provided so as to project in the upper direction in the base portion 3*a* with respect to each ink cartridge. One end of the ink supply pipe 4 is constituted so as to be inserted into an ink supply port 14 of the ink cartridge 2 as will be described below. In addition, the other end of the ink supply pipe 4 is connected to the ink tube 6. Therefore, the ink supply pipe 4 is communicated with the buffer tank 8 through the ink tube 6. In addition, one end of the air introduction pipe 5 is constituted so as to be inserted into an air inlet 15 of the ink cartridge 2. Furthermore, the other end of the air introduction pipe 5 is connected to an air introduction tube 18. Therefore, the air introduction pipe 5 is communicated with the air through the air introduction tube 18.

As shown in FIG. 1, because the attaching unit 3 of the ink cartridge 2 is disposed below (at a position lower than) the guide shafts 19 and 19 on which the carriage 7 is mounted, the head of the ink in the buffer tank 8 is higher than that of the ink in the ink cartridge 2. Thus, a pressure difference to flow the ink from the buffer tank 8 to the ink cartridge 2 is generated by the difference between both heads.

Next, the configuration of the ink cartridge 2 will be described hereinafter. The ink cartridge 2 has a body case 2*b* of an approximately box shape made of a resin, and a storage chamber 2*a* which becomes a spade for storing the ink in the storage chamber 2*a*. As described above, the ink supply port 14 and the air inlet 15 to which the ink supply pipe 4 and the air introduction pipe 5 are inserted, respectively when the ink cartridge 2 is attached to the attaching unit 3, are provided in a bottom portion 2*c* of the body case 2*b*. A valve member 16 and a pressure member 17 are provided so as to cover the ink supply port 14 and the air inlet 15, respectively. Thus, when the ink cartridge 2 is not attached to the attaching unit 3, communication between the inside and the outside of the ink cartridge 2 is sealed.

The valve member 16 and the pressure member 17 are formed of a resin material. The pressure members 17 fixed by a supporting portion 17*a* are elastically press the valve members 16 in the lower direction, so that the ink supply port 14 and the air inlet 15 can be covered and closed. When the ink cartridge 2 is attached to the attaching unit 3, as shown in FIG. 2B, the tip ends of the ink supply pipe 4 and the air introduction pipe 5 are inserted into the ink cartridge 2 and abut on the valve members 16, as the result the valve members 16 are pressed to the upper direction from the lower side. As a result, since the ink supply pipe 4 and the air introduction pipe 5 are communicated with each other inside the storage chamber 2*a*, the ink and air can be introduced into the ink cartridge through the ink supply pipe 4 and the air introduction pipe 5, respectively.

Figure 3:
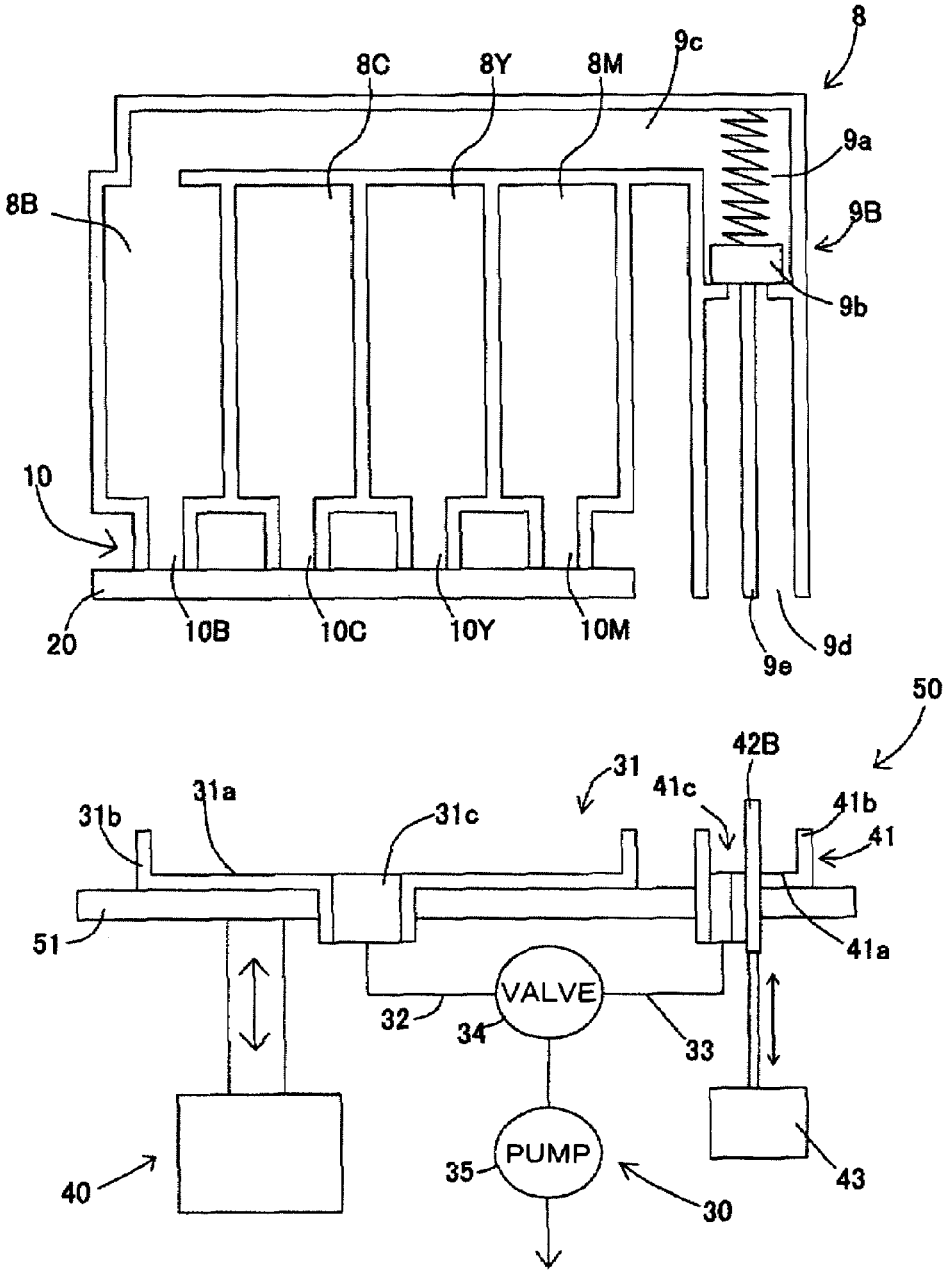
FIG. 3 is a longitudinal sectional view showing a configuration example of the buffer tank and a maintenance unit.

FIG. 3 is a longitudinal sectional view showing a configuration example of the buffer tank and the maintenance unit.

As shown in FIG. 3, the buffer tank 8 integrally comprises the buffer tanks 8B, 8C, 8Y and 8M in which the ink of the respective colors supplied from the ink cartridges 2B, 2C, 2Y and 2M are stored, respectively. One end of the ink tube 6 is connected to the buffer tank 8 at a connecting port 8*a* (refer to FIG. 2A). Thus, the ink is supplied from the ink flow pipes 10B, 10C, 10Y and 10M of the respective buffer tanks 8B, 8C, 8Y and 8M to the respective nozzle rows of the recording head 20, respectively. In addition, the buffer tanks 8B, 8C, 8Y and 8M comprise exhaust sections 9B, 9C, 9Y and 9M, respectively (refer to FIG. 1). Each exhaust section 9 comprises an exhaust path 9*c* communicated with each of the upper portions of the respective buffer tanks 8B, 8C, 8Y and 8M as shown in FIG. 3. Further, each exhaust path 9*c* comprises an exhaust valve 9*b*. Although only the exhaust section 9B communicated with the buffer tank 8B for black is shown in FIG. 3, similarly, exhaust sections 9C, 9Y and 9M for other colors each having the exhaust path 9*c* and the exhaust valve 9*b* are provided on the buffer tanks 8C, 8Y and 8M comprise, respectively.

Each exhaust path 9*c* extends from each of the upper surfaces of the buffer tanks 8B, 8C, 8Y and 8M along each side surface thereof in the lower direction, and its lower end portion is opened approximately on the same plane as the nozzle surface of the recording head 20. Lower end openings 9*d* of the exhaust paths 9*c* of the respective buffer tanks 8B, 8C, 8Y and 8M are aligned in line along the side surfaces of the buffer tanks 8B, 8C, 8Y and 8M. The exhaust valve 9*b* is pressed by an elastic member 9*a* such as a spring member in the direction to close the exhaust path 9*c*. An exhaust valve rod 9*e* is connected to the exhaust valve 9*b*. The exhaust valve rod 9*e* extends to the vicinity of the lower end opening 9*d* of the exhaust path 9*c*. When the exhaust valve rod 9*e* is abutted by a projecting portion 42B of a exhaust cap 41 that will be described below, it is raised so as to open the exhaust valve 9*b*. The exhaust valve 9*b* is closed in a normal state (when the ink is discharged from the recording head, for example). Therefore, in this state, the ink supplied from the ink tubes 6B, 6C, 6Y and 6M makes the bubble float the surface during flowing in the buffer tanks 8B, 8C, 8Y and 8M and the ink flow pipes 10B, 10C, 10Y and 10M. As the result, the bubble is accumulated in the upper portion of the buffer tanks 8B, 8C, 8Y and 8M and the exhaust paths 9*c*. The accumulated bubble can be exhausted by appropriately opening the exhaust valve 9*b*.

Since the exhaust path 9*c* and the exhaust valve 9*b* are provided in each of the buffer tanks 8B, 8C, 8Y and 8M of the respective ink color, ink of respective colors are not mixed at the buffer tanks 8B, 8C, 8Y and 8M side than the exhaust valve 9*b*. In addition, as will be described below, the opening and closing of the exhaust valve 9*b* can be controlled with respect to each ink color. That is, only regarding the ink cartridge 2 for the exchanged ink of a specific color, after the corresponding exhaust valve 9*b* has been opened, its suction operation can be performed. Therefore, the other ink is not wasted from the exhaust valve 9*b*, so that amount of waste ink can be reduced. In addition, the opening and closing operations of the exhaust valves 9*b* of the ink colors of cyan, yellow and magenta may be controlled at the same time separately from the exhaust vale 9*b* for the black ink.

Next, the maintenance unit 50 will be described hereinafter. As shown in FIG. 1 and FIG. 3, the maintenance unit 50 comprises, at a maintenance body unit 51, a suction cap 31 made of elastic material for covering the nozzle surface of the recording head 20, the exhaust cap 41 made of elastic material for covering the lower end opening 9*d* of the exhaust section 9, and a suction mechanism 30. Both the caps 31 and 41 can be lifted and lowered by a common first elevating mechanism 40 and tightly contacted and separated with and from the nozzle surface of the recording head 20 and the lower end opening 9*d* of the exhaust section 9, respectively. The suction mechanism 30 comprises a switching valve 34 communicated with exhaust outlets 31*c* and 41*c* of both caps 31 and 41 through suction tubes 32 and 33, respectively, and a suction pump 35 communicated with the down stream side of the switching valve 34. The switching valve 34 is provided for selectively communicating the suction pump 35 with the suction cap 31 or the exhaust cap 41. The waste ink discharged from the suction pump 35 is stored in a well-known waste ink storage (not shown).

As shown in FIG. 1, the exhaust cap 41 is formed into an approximately rectangular shape so as to correspond to the row of the lower end openings 9*d* of the exhaust sections 9, and as shown in FIG. 3, comprises a bottom portion 41*a* and a lip portion 41*b* rising from the bottom portion 41*a* so as to surround it. When the lip portion 41*b* is tightly contacted with the lower end opening 9*d* of the exhaust section 9 by lifting the maintenance body unit 51 by the first elevating mechanism 40, the exhaust cap 41 comes to be capable of suctioning the ink. In addition, the projecting portions 42 (the projecting portion 42B for the black ink is only shown in FIG. 3) are provided in the exhaust cap 41 at the positions corresponding to the exhaust valve rods 9*e* provided for the respective ink colors. Each projecting portion 42 can selectively raise the exhaust valve rod 9*e* by a second elevating mechanism 43. Thus, each projecting portion 42 can open each exhaust valve 9*b* against each spring member 9*a*. In addition, the exhaust outlet 41*c* for suctioning the bubble from the opened exhaust path 9*c* in the buffer tank 8 is provided in the bottom portion 41*a* of the exhaust cap 41. The exhaust outlet 41*c* is connected to the suction pump 35 through the switching valve 34.

In the state where the exhaust cap 41 is tightly contacted with the lower end opening 9*d* of the exhaust section 9 and the projecting portion 42 is driven by the second elevating mechanism 43 to open the exhaust valve 9*b*, when the switching valve 34 is switched to the position in which the exhaust cap 41 is communicated with the suction pump 35 and the suction pump 35 is driven, the bubble accumulated in the upper portion of the buffer tank 8 and the exhaust section 9 can be suctioned. Although the projecting portion 42B for the black ink among the projections 42 is only shown in FIG. 3, projections 42C, 42Y and 42M for the respective ink colors are provided at the positions corresponding to the exhaust valves 9*b* for the respective color inks as shown in FIG. 1. Therefore, in the buffer tanks 8C, 8Y and 8M for the respective colors, the bubble can be suctioned in the same configuration as the above.

Meanwhile, the suction cap 31 covering the nozzle surface of the recording head 20 is formed into the rectangular shape long in the X direction so as to surround all the nozzle rows. The suction cap 31 comprises a bottom portion 31*a* and a lip portion 31*b* rising from the bottom portion 31*a* so as to surround it. Similar to the exhaust cap 41, the suction cap 31 can be tightly contacted with the nozzle surface when the maintenance body unit 51 is lifted by the first elevating mechanism 40. The exhaust outlet 31*c* is provided in the bottom portion 31*a* of the suction cap 31. The exhaust outlet 31*c* is connected to the suction pump 35 through the switching valve 34. When the switching valve 34 is switched to the position in which the suction cap 31 is communicated with the suction pump 35 and the suction mechanism 30 is driven, ink whose viscosity is high and/or ink containing bubble in the recording head can be suctioned. In addition, when the suction is not performed, the lip portion 31*b* is tightly contacted with the nozzle surface to prevent the ink from evaporating, so that ink meniscus can be maintained.

Figure 4:
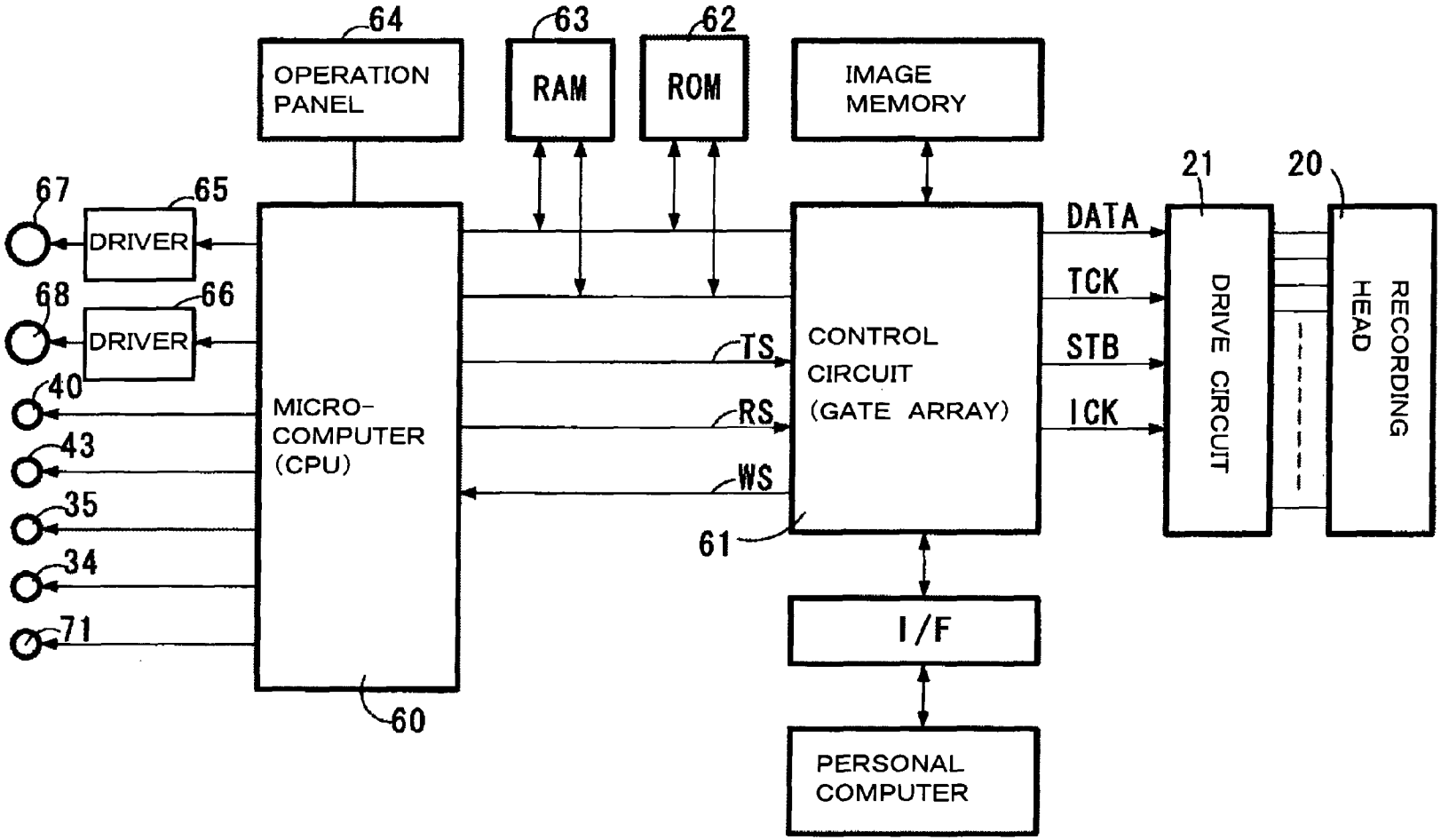
FIG. 4 is a circuit block diagram showing a configuration of a control system of the ink-jet printer.

Next, an electric configuration of the ink-jet printer 1 according to the embodiment will be described. FIG. 4 is a circuit block diagram showing the configuration of a control system for the ink-jet printer.

The control apparatus of the ink-jet printer 1 comprises a one-chip microcomputer (referred to as the CPU) 60 for controlling each unit of the entire ink-jet printer, a control circuit 61 as an LSI of a gate array, a ROM 62 for storing various control programs, driving waveform data and the like for discharging the ink, and a RAM 63 for storing data temporally.

To the CPU 60, an operation panel 64 for inputting various kinds of orders through operation of buttons, a motor driver 65 for driving a carriage motor 67 for reciprocating the carriage 7, a motor driver 66 for driving a conveyance motor 68 for driving a conveying apparatus of a printing paper, the first elevating mechanism 40 for the maintenance body unit 51, the second elevating mechanism 43 for the projecting portions 42B, 42C, 42Y and 42M, an ink cartridge sensor 71 for detecting that the ink cartridge 2 is in a normal attached state, the switching valve 34 and the suction pump 35 of the suction mechanism 30 and the like are connected. In addition, the CPU 60 incorporates a counter as a timer for counting clocks to measure a time.

The recording head 20 is driven by recording data DATA outputted from the control circuit 61 through the drive circuit 21.

Next, the method for attaching the ink cartridge 2 will be described with reference to the schematic views showing a procedure thereof shown in FIG. 5A, FIG. 5B and FIG. 5C, and a flowchart showing the control procedure by the CPU at the time of attaching the ink cartridge shown in FIG. 6. In addition, the control procedure shown in the flowchart in FIG. 6 has been previously stored in the ROM 62 shown in FIG. 4 as a program and it is executed by the CPU 60.

Attaching of the ink cartridge 2 is carried out under the state where the suction cap 31 has been tightly contacted with the recording head 20 and the carriage 7 has been positioned so that it can suction the recording head 20. In this state, it is noted that although the exhaust cap 41 is tightly contacted with the lower end opening 9*d* of the exhaust section 9, the projecting portion 42 is at the lowered position and the exhaust valve 9*b* is in a closed state.

Figure 5A:
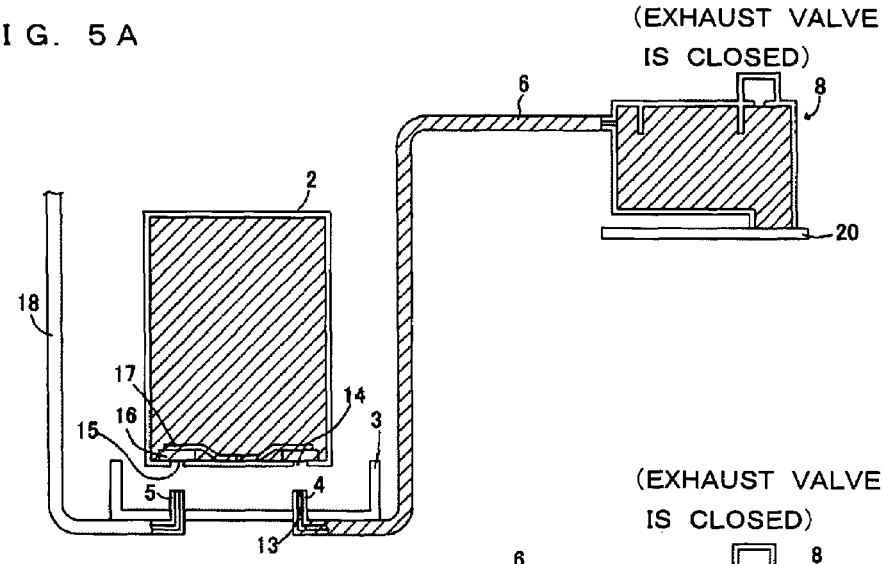
FIG. 5A is a schematic view showing the state before the ink cartridge is attached to explain the procedure of a method for attaching the ink cartridge.
Figure 5B:
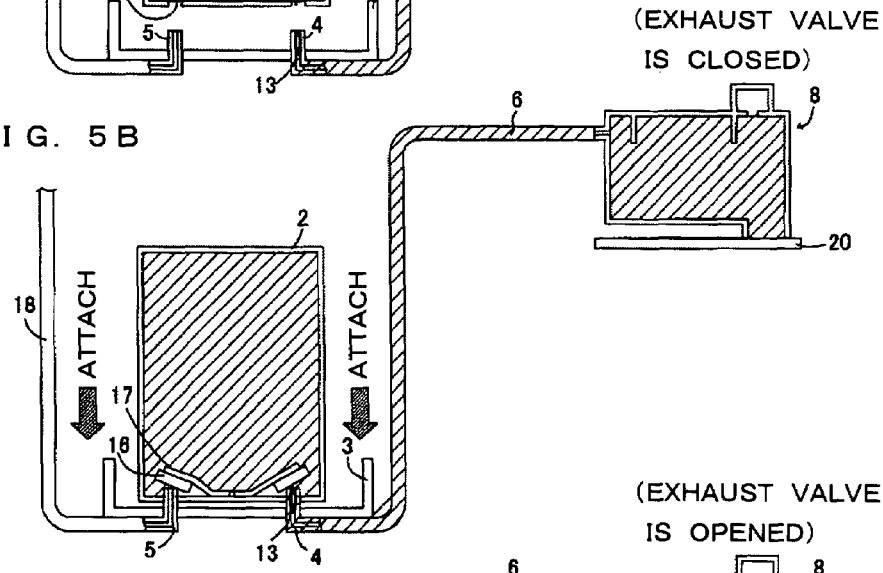
FIG. 5B is a schematic view showing the state a new ink cartridge 2 is attached to explain the procedure of the method for attaching the ink cartridge.
Figure 5C:
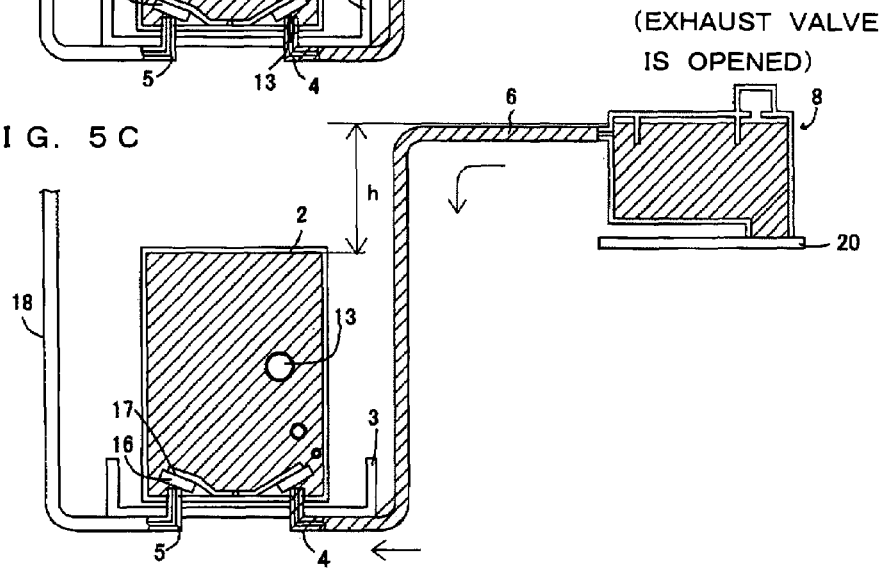
FIG. 5C is a schematic view showing the state the exhaust valve of the buffer tank is opened to explain the procedure of the method for attaching the ink cartridge.

When the ink cartridge 2 is attached for the first time, or when an old ink cartridge 2 is exchanged to a new ink cartridge, there is no ink in the ink supply pipe 4 but bubble 13 exists there instead as shown in FIG. 5A. In this state, when the ink cartridge 2 is attached, bubble is trapped in the vicinity of the tip end of the ink supply pipe 4 of the attaching unit 3. Even if the upper end portion of the ink supply pipe 4 is filled with the ink, since air exists below the valve member 16 of the ink cartridge 2, when the ink supply pipe 4 is inserted into the ink supply port 14, air enters between the upper end portion of the ink supply pipe 4 and the valve member 16.

Thus, at the time of attaching the ink cartridge 2, based on the detection operation of the ink cartridge sensor 71 (step S1), more specifically, when the ink cartridge sensor 71 detects that the ink cartridge 2 has been attached, the CPU 60 drives the second elevating mechanism 43 of the maintenance device 50. Thus, as shown in FIG. 5C, the exhaust valve 9*b* of the exhaust section 9 of the buffer tank 8 is opened (step S2). At the same time, the counter incorporated in the CPU 60 starts to count an elapsed time t (sec) from the time when the ink cartridge 2 is attached (steps S3 and S4).

As described above, when the exhaust valve 9*b* of the exhaust section 9 of the buffer tank 8 is opened, since air pressure is applied to the ink in the buffer tank 8, the ink in the ink tube 6 flows in the ink cartridge 2 due to the pressure corresponding to the head difference h (refer to FIG. 5C) between the head of the ink of the buffer tank 8 and the head of the ink of the ink cartridge 2. Thus, the bubble entering the ink supply pipe 4 is pushed out to the side of the ink cartridge 2. In addition, the bubble entering between the ink supply pipe 4 and the valve member 16 floats to the upper portion of the ink cartridge 2. Therefore, the bubble does not enter the ink supplied from the ink cartridge 2 to the ink supply tube 4.

By the way, when the elapsed time t (sec) from the time when the counter starts to count becomes more than a predetermined time (YES at step S4), the CPU 60 close the exhaust valve 9*b* by returning the second elevating mechanism 43 to the lowering state (step S5). This opening duration of the exhaust valve 9*b* until the step S5 may be a relatively short time, that is, a time required for moving the ink by a predetermine amount so that the bubble can be removed from the ink in the vicinity of the connection portion between the ink supply pipe 4 and the ink cartridge 2.

At this time, however, the meniscus of the ink could be retreated or destroyed in the nozzles of the recording head 20 due to the flow of the ink from the buffer tank 8 to the ink tube 6. To prevent this, after the exhaust valve 9*b* has been returned to the closed position, the CPU 60 drives the suction mechanism 30 with the suction cap 31 of the maintenance unit 50 tightly contacted with the nozzle surface of the recording head 20, to suction the ink from the nozzles (step S6). As a result, when the ink is supplied to the buffer tank 8 again and the sealed buffer tank 8, ink cartridge 2 and ink tube 6 are connected with the ink. Therefore, since a regular negative pressure (back pressure) is applied to the ink in the nozzles of the recording head 20 due to the head difference h between the head of the ink of the buffer tank 8 and the head of the ink of the ink cartridge 2, the meniscus of the nozzles can be rearranged in the normal position and the ink can be normally discharged from the recording head.

In addition, the ink may be supplied to the buffer tank 8 by tightly connecting the exhaust cap 41 with the lower end opening 9*b* of the exhaust section 9, and suctioning the ink through the exhaust section 9 by the suction mechanism 30. In this case, after the predetermined time has been elapsed (YES at step S4) from the opening of the exhaust valve 9*b* (step S2), the suction mechanism 30 is driven as described above and then the exhaust valve 9*b* is closed (step S5).

Figure 6:
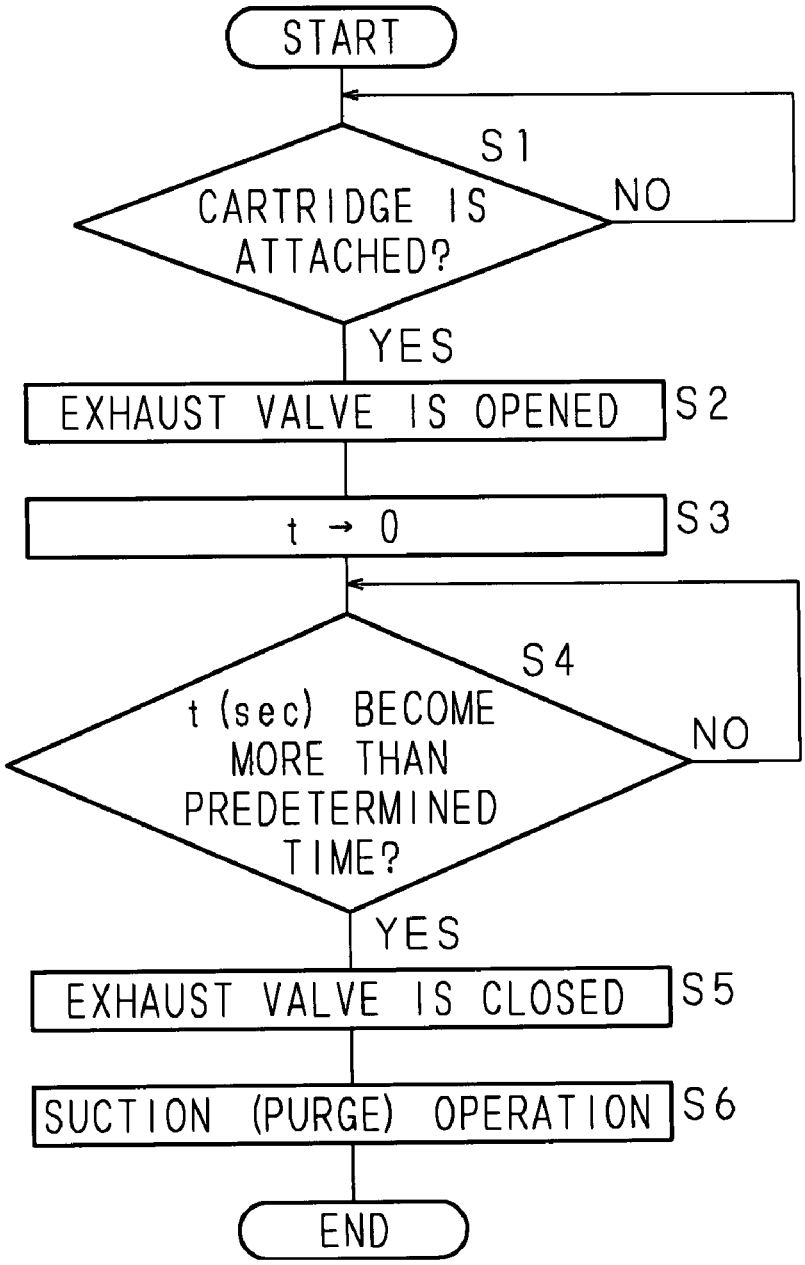
FIG. 6 is a flowchart showing a control procedure by a CPU when the ink cartridge is attached.
Figure 7:
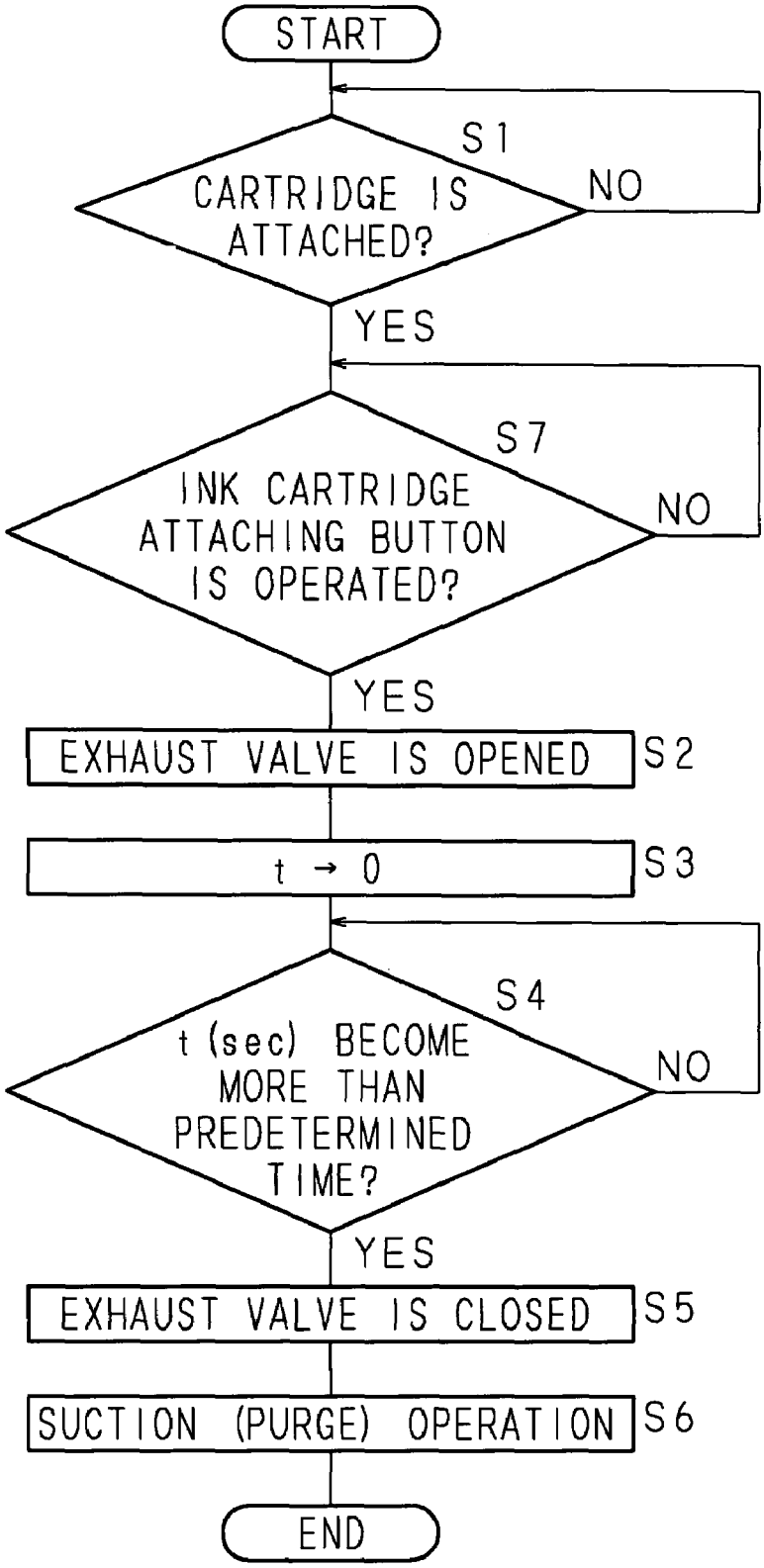
FIG. 7 is a flowchart showing a method for attaching another ink cartridge according to this embodiment.

Another processing procedure of an embodiment different from the processing procedure shown in the flowchart in FIG. 6, is shown in a flowchart shown in FIG. 7.

More specifically, after a user has attached a new ink cartridge 2 to the attaching unit 3 (YES at step S1), the user operates an ink cartridge attaching button (not shown) provided in the operation panel 64 (YES at step S7). The CPU 70 counts the elapsed time t (sec) from the time when the ink cartridge attaching button is operated by the counter like the above embodiment and then the same processing is performed as the above embodiment.

According to this embodiment, the series of operation are performed only when the user operates the ink cartridge attaching button, in other words, at any timing by the user.

In addition, the suction operation (step S6) may be automatically controlled so as to be performed after the opening/closing of the exhaust valve 9*b* or may be performed when the user operates a purge operation button (not shown) provided in the operation panel 64.

Furthermore, although the suction cap 31 and the exhaust cap 41 are lifted and lowered by the common first elevating mechanism 40 in the above embodiment, they may be separately lifted and lowered by different elevating mechanism. In this case, when the ink cartridge 2 is attached, the suction cap 31 is tightly contacted with the recording head 20 while the exhaust cap 41 can be apart from the lower end opening 9*d* of the exhaust section 9. Thus, each projection 42 can be integrally fixed to the exhaust cap 41. This enables that all the exhaust valves 9*b* can be opened at the same time when the exhaust cap 41 is closely attached to the lower end openings 9*d* of the exhaust sections 9, so that bubble can be suctioned from all the exhaust sections 9 at the same time. Furthermore, the ink may be supplied to the buffer tank 8 after the bubble that entered at the time of attaching the ink cartridge 2 has been removed by applying a positive pressure to the ink from the side of the ink cartridge 2.

As described above, according to the present invention, when the ink cartridge 2 is attached, air that entered in the ink supply path can be pushed out with the ink from the ink supply path to the side of the ink cartridge 2 by an easy configuration and method. In addition, when the ink is supplied from the ink cartridge 2 to the buffer tank 8 again by the suction operation, amount of waste ink can be reduced as compared with the configuration in which the suction operation is performed periodically like the conventional case.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A method for attaching an ink cartridge to an ink-jet printer, the ink-jet printer being provided with:

a carriage on which a recording head having nozzles for discharging ink and a buffer tank for supplying the ink to the recording head are mounted;

an exhaust valve provided on an exhaust path that exhausts air in the buffer tank to the outside;

an attaching unit disposed outside the carriage and at a height lower than the recording head, to which the ink cartridge is detachably attached;

an ink flow passage, to whose one end the ink cartridge to be attached to the attaching unit is detachably connected, that supplies the ink in the ink cartridge to the buffer tank;

a sensor that detects whether or not the cartridge is attached to the attaching unit; and a control circuit that controls the exhaust valve;

the method comprising:

detecting by the sensor whether or not the cartridge is attached to the attaching unit;

opening the exhaust valve by the control circuit when the sensor detects a change from a state where the cartridge is not attached to the attaching unit to a state where the cartridge is attached to the attaching unit; and moving the ink in the vicinity of the one end of the ink flow passage to which the ink cartridge is connected, into the ink cartridge, by moving the ink in the ink flow passage from the side of the buffer tank to the side of the ink cartridge due to a head difference between a head of the ink in the buffer tank and a head of the ink in the ink cartridge when the valve is opened.

2. The method as set forth in claim 1, further comprising:

moving the ink by a predetermined amount by closing the exhaust valve after a predetermined duration; and thereafter supplying the ink from the ink cartridge to the buffer tank through the ink flow passage.

3. The method as set forth in claim 1, wherein a plurality of the ink cartridges can be attached to the attaching unit;

a same number of the buffer tanks and the ink flow passages as the number of the ink cartridges attachable to the attaching unit are provided, the exhaust valve is provided for the respective buffer tanks, and the exhaust valve corresponding to the ink cartridge that is attached to the attaching unit is opened.

4. The method as set forth in claim 3, further comprising:

moving the ink by a predetermined amount by closing the exhaust valve after a predetermined duration; and thereafter supplying the ink from the ink cartridge to the buffer tank through the ink flow passage.

5. An ink-jet printer, comprising:

a carriage on which a recording head having nozzles for discharging ink and a buffer tank for supplying the ink to the recording head are mounted;

an exhaust valve provided on an exhaust path that exhausts air in the buffer tank to the outside;

an attaching unit disposed outside the carriage and at a height lower than the recording head, to which the ink cartridge is detachably attached;

an ink flow passage, to whose one end the ink cartridge to be attached to the attaching unit is detachably connected, that supplies the ink in the ink cartridge to the buffer tank;

a sensor that detects whether or not the cartridge is attached to the attaching unit; and a control circuit that opens the exhaust valve when the sensor detects a change from a state where the cartridge is not attached to the attaching unit to a state where the cartridge is attached to the attaching unit;

whereby the ink in the vicinity of the one end of the ink flow passage to which the ink cartridge is connected moves into the ink cartridge, by moving the ink in the ink flow passage from the side of the buffer tank to the side of the ink cartridge due to a head difference between a head of the ink in the buffer tank and a head of the ink in the ink cartridge when the valve is opened.

6. The ink-jet printer as set forth in claim 5, further comprising a switch that can be operated when the ink cartridge is attached, wherein the control circuit opens the exhaust valve when the switch is operated.

7. The ink-jet printer as set forth in claim 5, further comprising a counter that counts an elapsed time, wherein the control circuit opens the exhaust valve during a predetermined time until the counter counts the predetermined time, to move the ink by a predetermined amount.

8. The ink-jet printer as set forth in claim 7, further comprising a switch that can be operated when the ink cartridge is attached, wherein the control circuit opens the exhaust valve when the switch is operated.

9. The ink-jet printer as set forth in claim 5, further comprising an ink supply mechanism that supplies the ink from the ink cartridge attached to the attaching unit to the buffer tank through the ink flow passage.

10. The ink-jet printer as set forth in claim 9, wherein the ink supply mechanism comprises a cap opposed to the recording head and a pump that suctions the ink from the nozzles, under a state where the carriage is positioned at a predetermined position.

11. The ink-jet printer as set forth in claim 10, further comprising a counter that counts an elapsed time, wherein the control circuit opens the exhaust valve during a predetermined time until the counter counts the predetermined time, to move the ink by a predetermined amount.

12. The ink-jet printer as set forth in claim 11, further comprising a switch that can be operated when the ink cartridge is attached, wherein the control circuit opens the exhaust valve when the switch is operated.

13. The ink-jet printer as set forth in claim 5, wherein a plurality of the ink cartridges can be attached to the attaching unit;

a same number of the buffer tanks and the ink flow passages as the number of the ink cartridges attachable to the attaching unit are provided, the exhaust valve is provided for the respective buffer tanks, and the exhaust valve corresponding to the ink cartridge that is attached to the attaching unit is opened.

14. The ink-jet printer as set forth in claim 13, further comprising an ink supply mechanism that supplies the ink from the ink cartridge attached to the attaching unit to the buffer tank through the ink flow passage.

15. The ink-jet printer as set forth in claim 14, wherein the ink supply mechanism comprises a cap opposed to the recording head and a pump that suctions the ink from the nozzles, under a state where the carriage is positioned at a predetermined position.

16. The ink-jet printer as set forth in claim 15, further comprising a counter that counts an elapsed time, wherein the control circuit opens the exhaust valve during a predetermined time until the counter counts the predetermined time, to move the ink by a predetermined amount.

17. The ink-jet printer as set forth in claim 16, further comprising a switch that can be operated when the ink cartridge is attached, wherein the control circuit opens the exhaust valve when the switch is operated.

* * * * *